United States Patent [19]

Nakanishi

[11] Patent Number: 4,877,232

[45] Date of Patent: Oct. 31, 1989

[54] PAPER DISCHARGE APPARATUS

[75] Inventor: Tomoyuki Nakanishi, Moriyama, Japan

[73] Assignee: Omron Tateisi Electronics Co., Kyoto, Japan

[21] Appl. No.: 203,813

[22] Filed: Jun. 8, 1988

[30] Foreign Application Priority Data

Jun. 15, 1987 [JP] Japan ..... 62-91624[U]

[51] Int. Cl.[4] ..... B65H 3/06

[52] U.S. Cl. ..... 271/10; 271/110; 271/245; 271/263

[58] Field of Search ..... 271/10, 109, 110, 111, 271/121, 122, 125, 245, 258, 259, 263, 262, 265, 189

[56] References Cited

U.S. PATENT DOCUMENTS 3,952,183 4/1976 Abe ..... 271/149 X
4,397,455 8/1983 Hickey ..... 271/263 X
4,560,159 12/1985 Staub ..... 271/263
4,681,229 7/1987 Uesaka ..... 271/3.1 X
4,721,229 1/1988 Dempf ..... 271/220 X

*Primary Examiner*—Richard A. Schacher
*Attorney, Agent, or Firm*—Stevens, Davis, Miller & Mosher

[57] ABSTRACT

To reduce a distance between a bill container and a bill discharge outlet and eliminate a complicated bill rearrangement mechanism in a bill discharge apparatus incorporated in cash handling machines, bills are discharged and conveyed one by one a little shifted with one end of a bill superposed upon the other end of another bill. The apparatus comprises first and second let-out rollers for letting out bills in sequence under partial superposed condition; a paper conveying device for conveying the paper delivered by the let-out rollers, a paper stopper for stopping conveyed paper; and a paper thickness sensor disposed between the first let-out roller and the paper stopper.

3 Claims, 3 Drawing Sheets

PAPER DISCHARGE APPARATUS

BACKGROUND OF THE INVENTION

1. Field of the Invention

The present invention relates to a paper discharge apparatus for discharging paper such as bills accommodated within bank transaction machine such as automatic deposite and payment transaction machines, automatic cash dispensing machines, automatic cash exchanging machines, etc.

2. Description of the Prior Art

In the above-mentioned automatic bank transaction machines, a reliable paper (bill) discharge apparatus is needed. In the prior-art apparatus, when a plurality of bills are required to be discharged, usually bills are let out and separated one by one from a bill container disposed within the machine in such a way that predetermined intervals can be retained between two conveyed bills. This is because it is necessary to reliably count the number of bills to be discharged. In the prior-art bill discharge apparatus, however, there exist problems in that a large space or a long distance is required from the bill container to the bill discharge chute (bill discharge outlet) and additionally a complicated mechanism (e.g. a bill temporarily stacking device or a bill rearrangement mechanism) is necessary in order to rearrange the discharged bills into an accurately stacked condition.

SUMMARY OF THE INVENTION

With these problems in mind, therefore, it is the primary object of the present invention to provide a paper discharge apparatus which can reduce the distance between the bill container and the bill discharge outlet and further eliminate a complicated bill rearrangement mechanism.

To achieve the above-mentioned object, in the present invention, bills are let out from a bill container and then conveyed under such a state that two bills are shifted a little from each other in the bill feed direction with part of a preceding bill superposed upon part of a succeeding bill. That is, a paper discharge apparatus for discharging paper in sequence beginning from an endmost paper of a plurality of papers accommodated in a container according to the present invention, comprises: (a) first let-out roller means, disposed in contact with a portion adjacent to a first end of an endmost paper, for discharging the endmost paper; (b) second let-out roller means, disposed in contact with a portion adjacent to a second end of the same endmost paper remote from the first end, for discharging a second paper in contact therewith after the first let-out roller means has let out the endmost paper a little; (c) paper conveying means for conveying the paper delivered by the first and second let-out roller means to a paper discharge outlet; (d) paper stopping means, movably disposed midway of said paper conveying means, for stopping paper being conveyed when moved into a paper convey path of the paper conveying means; and (e) paper thickness sensing means, disposed between the first let-out roller means and the paper stopping means, for detecting a thickness of paper being conveyed by the paper conveying means.

In the paper discharging apparatus of the present invention, when the first and second let-out roller means are driven, a first endmost paper is discharged in the paper feed direction. Immediately after the first endmost paper has been separated from the second let-out roller means, the second let-out roller means is brought into contact with the second paper, so that the second paper is delivered a little shifted from the first paper under partial superposed positional relationship to each other. When the paper is being conveyed by the paper conveying means, the numer of papers delivered and conveyed is detected in response to the signal from the paper thickness sensing means. In the above paper discharge operation, the discharged papers are once stacked temporarily on the paper convey path of the conveying means, because the forward end of each discharged paper is brought into contact with the paper stopper means moved to the paper convey path for paper rearrangement. When the paper counting means counts a predetermined number of papers, the paper stopper means is moved out of the paper convey path to discharge the temporarily stacked papers into a paper discharge outlet all together under well stacked arrangement condition.

In the apparatus of the present invention, since the continuously discharged proceeding and succeeding papers are conveyed under partial superposed positional relationship to each other, it is possible to reduce the space between the paper container and the paper discharge outlet, and therefore to reduce the size of the paper discharge apparatus. Further, since a plurality of papers are discharged under superposed condition, the continuously discharged papers can be rearranged by means of a simple stopper member, without need of a special complicated paper rearrangement mechanism as in the prior-art apparatus. Further, in this apparatus, although the papers are delivered under partial superposed condition, since the number of papers can be accurately detected on the basis of the output signal of the paper thickness sensing means, it is possible to reliably count the number of papers being conveyed.

DETAILED DESCRIPTION OF THE EMBODIMENT

An embodiment of the apparatus of the present invention will be described hereinbelow with reference to the attached drawings.

Figure 1:
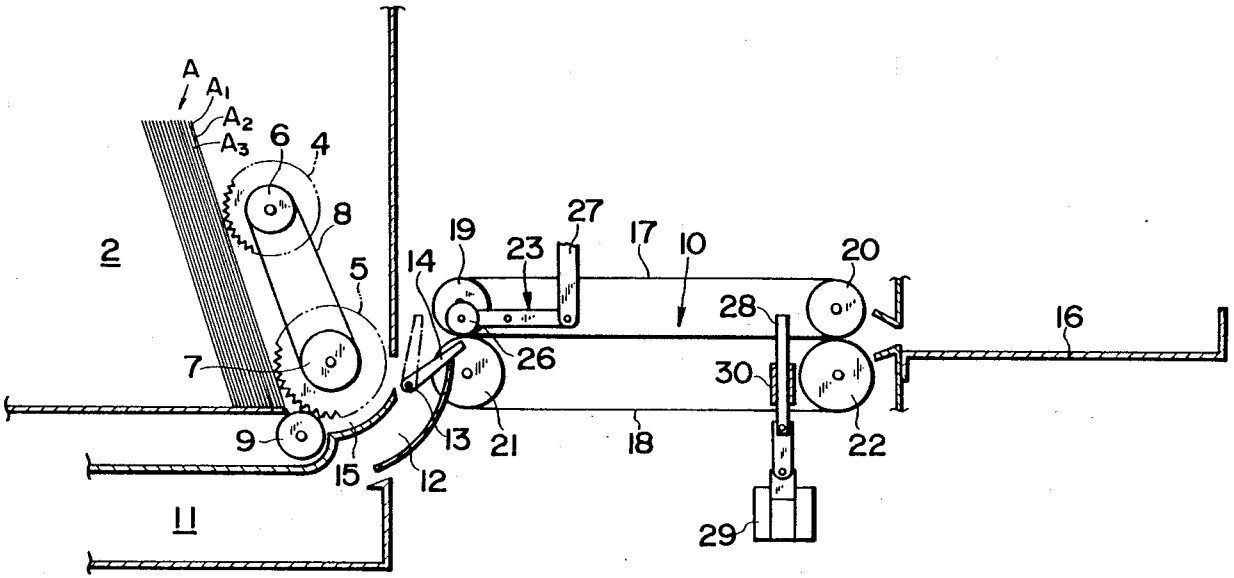
FIG. 1 is a cross-sectional view showing an embodiment of a bill discharge apparatus according to the present invention.

FIG. 1 shows an embodiment of the present invention. In the drawing, a bill accommodating section (i.e. bill container) 2 is provided within a body of the bill discharge apparatus. In this bill container 2, a plurality of bills are accommodated under inclined superimposed conditions with the lateral direction of the bill set vertically and the longitudinal direction thereof set horizontally.

In the bill container 2, a first main let-out roller 5 is rotatably disposed at the lower side of the bill container 2, and a second auxiliary let-out roller 4 is also rotatably disposed at the upper side of the bill container 2. These two rollers 5 and 4 constitute a bill let-out section. An endmost bill $A_1$ of the arranged bills A is in contact with these two rollers 4 and 5 being urged by a push plate (not shown) for urging the arranged bills from the left side to the right side in FIG. 1.

The auxiliary let-out roller 4 is fixed to a rotatable shaft to which a pulley 6 is fixed, and the main let-out roller 5 is fixed to a rotatable shaft to which a pulley 7 is fixed. A timing belt 8 is reeved around these two pulleys 6 and 7 to rotate the two rollers 4 and 5 in synchronism with each other. Further, each of these two rollers 4 and 5 is made of rubber into a ratchet-like wheel having small notches around the circumference thereof. The main let-out roller 5 is in contact with the lower side of an endmost bill $A_1$ and the auxiliary let-out roller 4 is in contact with the middle portion of the same endmost bill $A_1$.

Further, a contact roller 9 is disposed in contact with the main let-out roller 5. A bill delivered to between the main roller 5 and the contact roller 9 is fed first to a let-out port 15, in which a sorting flapper 14 pivotable about the axis 13 is disposed. When this sorting flapper 14 is positioned vertically as shown in FIG. 1, let-out bills (after once stacked on a discharge path 10) are collected back into a bill collecting box 11 via a collection path 12. When this sorting flapper 14 is disposed obliquely as shown in FIG. 1, let-out bills are fed to a bill discharge path 10 to discharge bills to a bill outlet plate 16 provided outside of the machine.

The bill discharge path 10 is formed by bill conveying means made up of two upper and lower belts 17 and 18, each reeved around two pulleys 19, 20, and 21, 22, respectively.

Figure 3:
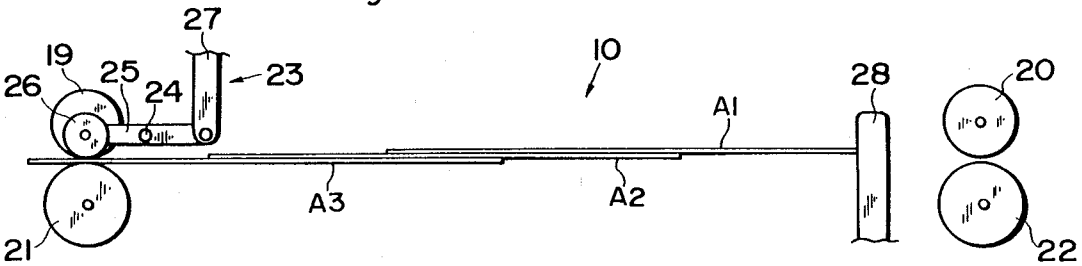
FIG. 3 is an illustration for assistance in explaining the bill discharge operation.

A thickness sensor 23 for detecting a thickness of bills is disposed in the bill discharge path 10 in the vicinity of the bill let-out port 15. As shown in FIG. 3, the thickness sensor 23 comprises a fixed shaft 24, a sensor arm 25 supported pivotally by the shaft 24, a sensing roller 26 rotatably supported at an end of the arm 25, and a connecting rod 27 rotatably connected to the other end of the arm 25. The sensing roller 26 is urged by a spring (not shown) toward the pulley 21 or a roller coaxial therewith. Therefore, a change in bill thickness can be detected in dependence upon a vertical movement of the connecting rod 27. The displacement of the connecting rod 27 or another member connected to the rod 27 can be detected by any well-known displacement sensor which generates a signal representative of the bill thickness. On the basis of this thickness sensor signal, it is possible to count the number of bills let out, as described later in more detail.

A stopper member 28 is disposed at the outlet side of the bill discharge path 10, as shown in FIG. 1. This stopper member 28 is controllably moved up and down by a solenoid while being guided by a guide sleeve 30. When the solenoid 29 is deenergized, for instance, the stopper member 28 is released and therefore moved upward by a solenoid spring (not shown) so as to be moved into the bill convey path 10. In this case, bills can be rearranged on the convey path 10 in stack condition. On the other hand, when the solenoid 29 is energized, the stopper member 28 is moved downward so as to be moved out of the bill convey path 10. In this case, bills can be discharged to the outlet plate 16.

Figure 2:
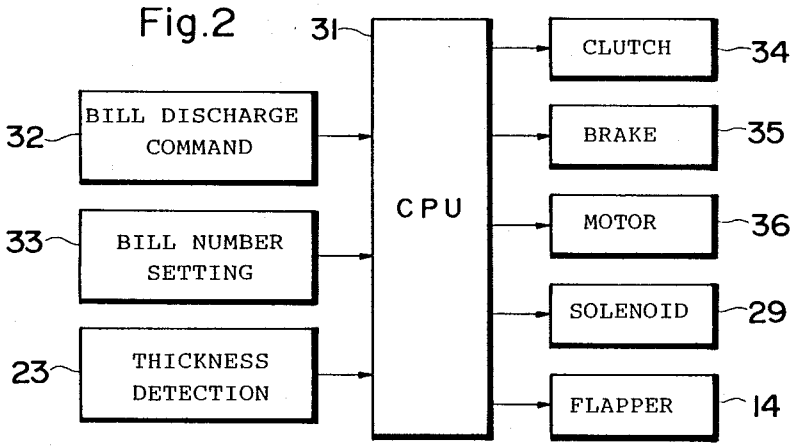
FIG. 2 is a block diagram showing a controller of the bill discharge apparatus shown in FIG. 1.

FIG. 2 shows a controller including a CPU of this apparatus. To this CPU 31, a bill discharge command signal 32, a discharged bill number setting signal 33, and an output signal of the thickness sensor 23 are inputted. In response to the bill discharge command signal 32, a clutch 34 for transmitting a rotational power is engaged to rotate the main let-out roller 5 and the auxiliary let-out roller 4. The CPU 31 counts the number of bills until the counted number reaches that represented by the bill number setting signal 33 and then a brake 35 is actuated to stop rotating the two rollers 4 and 5 to immediately stop the bill let-out operation.

Further, in response to the bill discharge command signal 32, the CPU 31 drives a motor 36 to run the belts 17 and 18 constituting the bill discharge path 10. Simultaneously, the stopper member 28 is moved upward into the bill discharge path 10 by deenergizing the solenoid 29. After a predetermined number of bills has let out of the container 2 and this number has been counted on the basis of output signals from the thickness sensor 23, the stopper member 28 is moved downward from the bill discharge path 10 by energizing the solenoid 29.

The operation of the bill discharge apparatus of the present invention will be described hereinbelow.

When a bill discharge command signal 32 is generated and a bill number (e.g. three) setting signal 33 is preset, the clutch 34 is engaged to rotate the main let-out roller 5 and the auxiliary let-out roller 4. Simultaneously, the motor 3 drives the belts 17 and 18; the solenoid 29 moves the stopper member 28 upward; the flapper actuator actuates the sorting flapper 14 obliquely so that the let-out port 15 communicates with the bill discharge path 10.

Therefore, the first endmost bill $A_1$ of the bills A arranged within the container 2 is fed by the main and auxiliary let-out rollers 5 and 4. When the endmost bill $A_1$ is fed toward the bill discharge port 15, since the rear end of the bill $A_1$ is separated from the auxiliary let-out roller 4, the auxiliary let-out roller 4 is brought into contact with the second bill $A_2$.

Since the roller 4 is a rubber ratchet-like wheel, the bill $A_2$ is also fed immediately. That is, the second succeeding bill $A_2$ is fed being shifted from and superposed upon the first preceding bill $A_1$ now being fed by the main let-out roller 5. The third bill $A_3$ is fed in the same way.

When the bill $A_1$ is fed into the bill discharge path 10, the bill thickness sensor 23 detects the passing of the first bill $A_1$. Thereafter, the first and second bills $A_1$ and $A_2$ are fed being shifted a little from and superposed upon each other, an increase in thickness due to partial bill superposition can be detected by the sensing roller 26 of the bill thickness sensor 23, so that the passing of the second bill $A_2$ can be detected. The passing of the third bill $A_3$ can be detected in the same way.

At the time when the bill thickness sensor 23 detects the passing of the third bill $A_3$, the clutch 34 is disengaged and the brake 35 actuates, so that the main and auxiliary rollers 5 and 4 are stopped from rotation. Although the rear end of the third bill $A_3$ still remains in the bill container s, since the forward end thereof is sandwiched between the two belts 17 and 18, the third bill $A_3$ can be fed forward into the bill discharge path 10. The above-mentioned three-bill continuous feeding operation is depicted in FIG. 3, in which the belts 17 and 18 are omitted to clarify the partial bill superposition states of three bills $A_1$, $A_2$ and $A_3$.

In FIG. 3, the forward ends of the three bills $A_1$, $A_2$ and $A_3$ are brought into contact with the stopper rod 28 in time sequence, the three bills are stacked and rearranged in good order. Thereafter, when the stopper rod 28 is moved downward from the discharge path 10, since the three stacked bills are released and therefore discharged to the bill outlet plate 16 by the moving belts 17 and 18 under bill stacked condition.

Further, in the above operation, when the CPU 31 cannot detect the number of bills on the basis of the output signals from the thickness sensor 23, a flapper actuator is actuated to pivot the flapper 14 to a vertical position as shown in FIG. 1, to communicate the bill discharge path 10 with the bill collection port 12. Under these conditions, if the belts are moved in the reverse direction, the bills on the bill discharge path 10 can be returned into the collection box 11.

Figure 4A:
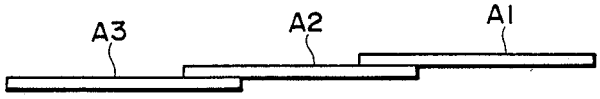
FIGS. 4*a* to 4*c* are illustrations for assistance in explaining the operation of detecting the number of delivered bills.
Figure 4B:
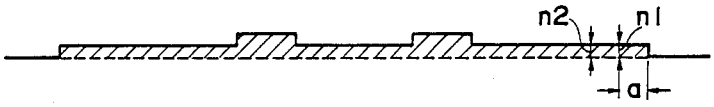
Figure 4C:
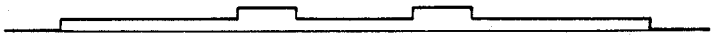

FIGS. 4*a* to 4*c* and 5 are illustrations for assistance in explaining the operation of the bill thickness sensor 23. Assumption is made that three bills $A_1$, $A_2$ and $A_3$ are fed along the bill discharge path 10 in partial superposition positional relationship to each other as shown in FIG. 4*a*. The change in thickness (cross-sectional area) of the partially superposed bills can be represented with the elapse of time as shown by FIG. 4*b*, so that it is possible to obtain an output signal of the thickness sensor 23, the waveform of which signal is shown in FIG. 4*c*, because the sensing roller 26 of the thickness sensor 23 follows the thickness change with the elapse of time.

Figure 5:
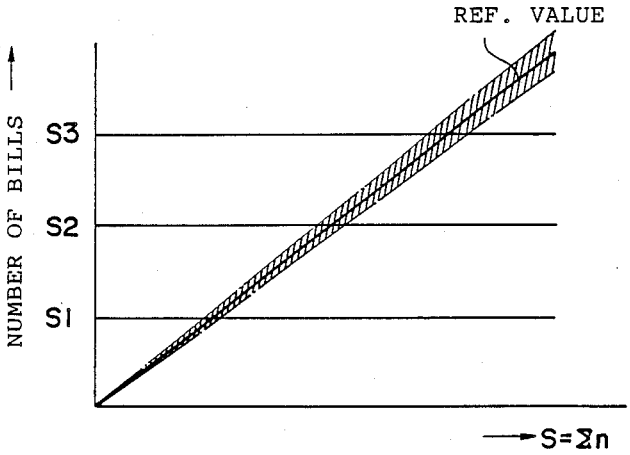
FIG. 5 is a graphical representation for assistance in explaining the processing of determining the number of bills.

The output signal levels ($n_1$, $n_2$ . . . ) of the thickness sensor 23 are sampled at regular time intervals, a, as shown in FIG. 4*b*, A/D converted, and integrated in accordance with program processing to obtain an integral value $S=\Sigma n$. On the other hand, the relationship between the integral value and the number of bills are previously determined and stored in a memory of the CPU 31 as shown in FIG. 5, in which the solid line indicates a reference integral and the shaded portion indicates an allowable range. Therefore, if S exceeds $S_1$, control determines that the number of bill is one; if S exceeds $S_2$, control determines that the number of bill is two, and so on.

Further, it is also possible to detect the number of bills by counting the number of the leading edges of the signal shown in FIG. 4*c*. Or else, there exist various method of detecting the number of bills.

As described above, in the paper discharge apparatus of the present invention, since bills let out of the bill container 2 are fed being shifted a little from or being superposed upon each other, without being separated completely, it is possible to reduce the distance between the bill container 2 and the bill discharge outlet. In addition, it is possible to automatically rearrange the bills conveyed to the bill discharge path 10 into good stacked conditions by simply moving up the stopper member 28 into the discharge path 10.

What is claimed is:

1. A paper discharge apparatus for discharging paper in sequence beginning from an endmost paper of a plurality of papers accommodated in a container, comprising:

(a) first let-out roller means, disposed in contact with a portion adjacent to a first end of an endmost paper, for discharging the endmost paper;

(b) second let-out roller means, disposed in contact with a portion adjacent to a second end of the same endmost paper remote from the first end, for discharging a second paper in contact therewith after said first let-out roller means has let out the endmost paper a little;

(c) paper conveying means for conveying the paper delivered by said first and second let-out roller means to a paper discharge outlet;

(d) means for operating said first and second let-out roller means and paper conveying means in order to feed papers from said plurality of papers in said container in an overlapped condition in which successive fed papers are shifted from one another in a direction of paper conveyance through said paper conveying means with a part of a preceding paper being superimposed upon part of a succeeding paper;

(e) paper stopping means, movably disposed midway of said paper conveying means, for stopping paper being conveyed when moved into a paper convey path of said paper conveying means; and (f) paper thickness sensing means, disposed between said first let-out roller means and said paper stopping means, for detecting a thickness of paper being conveyed by said paper conveying means.

2. The paper discharge apparatus as defined in claim 1, which further comprises paper counting means for counting the number of the discharged papers in response to an output signal from said paper thickness sensing means.

3. The paper discharge apparatus as defined in claim 2, wherein said operating means comprises control means for driving said first and second let-out roller means and simultaneously moving said paper stopper means into the paper convey path of said paper conveying means in response to a paper discharge start command, stopping driving said first and second let-out roller means when said paper counting means counts a predetermined number of discharged papers, and thereafter moving said paper stopping means out of the paper convey path of said paper conveying means.

* * * * *